United States Patent [19]

Hanzawa

[11] Patent Number: 4,538,496

[45] Date of Patent: Sep. 3, 1985

[54] ELECTRONIC MUSICAL INSTRUMENT

[75] Inventor: Koutarou Hanzawa, Fussa, Japan

[73] Assignee: Casio Computer Co., Ltd., Tokyo, Japan

[21] Appl. No.: 517,461

[22] Filed: Jul. 26, 1983

[30] Foreign Application Priority Data

Jul. 31, 1982 [JP] Japan ..... 57-134580
Jul. 31, 1982 [JP] Japan ..... 57-134581
Jul. 31, 1982 [JP] Japan ..... 57-134582

[51] Int. Cl.[3] ..... G10H 1/057
[52] U.S. Cl. ..... 84/1.26; 84/1.13
[58] Field of Search ..... 84/1.13, 1.22, 1.26, 84/1.27

[56] References Cited

U.S. PATENT DOCUMENTS 4,133,242 1/1979 Nagai et al. ..... 84/1.13
4,245,541 1/1981 Deutsch ..... 84/1.22
4,416,178 11/1983 Ishida ..... 84/1.27 X
4,442,745 4/1984 Gross et al. ..... 84/1.26 X

*Primary Examiner*—S. J. Witkowski
*Attorney, Agent, or Firm*—Frishauf, Holtz, Goodman & Woodward

[57] ABSTRACT

The differentiation data of a basic waveform is read out from a differentiated value waveform memory at a clock timing corresponding to a musical scale of an operated play key, and it is multiplied by an envelope value of a musical sound waveform to form a musical sound waveform differentiation value. In parallel therewith, the differentiation data is accumulated at the clock timing to form a compensative value. The compensative value is added with the musical sound waveform differentiation value at the point of time at which the envelope value is changed to cancel a DC component which would otherwise develop in a produced musical sound waveform. The musical sound waveform differentiation values thus compensated are accumulated, and are subjected to digital-to-analog conversion, so that the musical sound waveform free from the DC component is produced.

10 Claims, 69 Drawing Figures

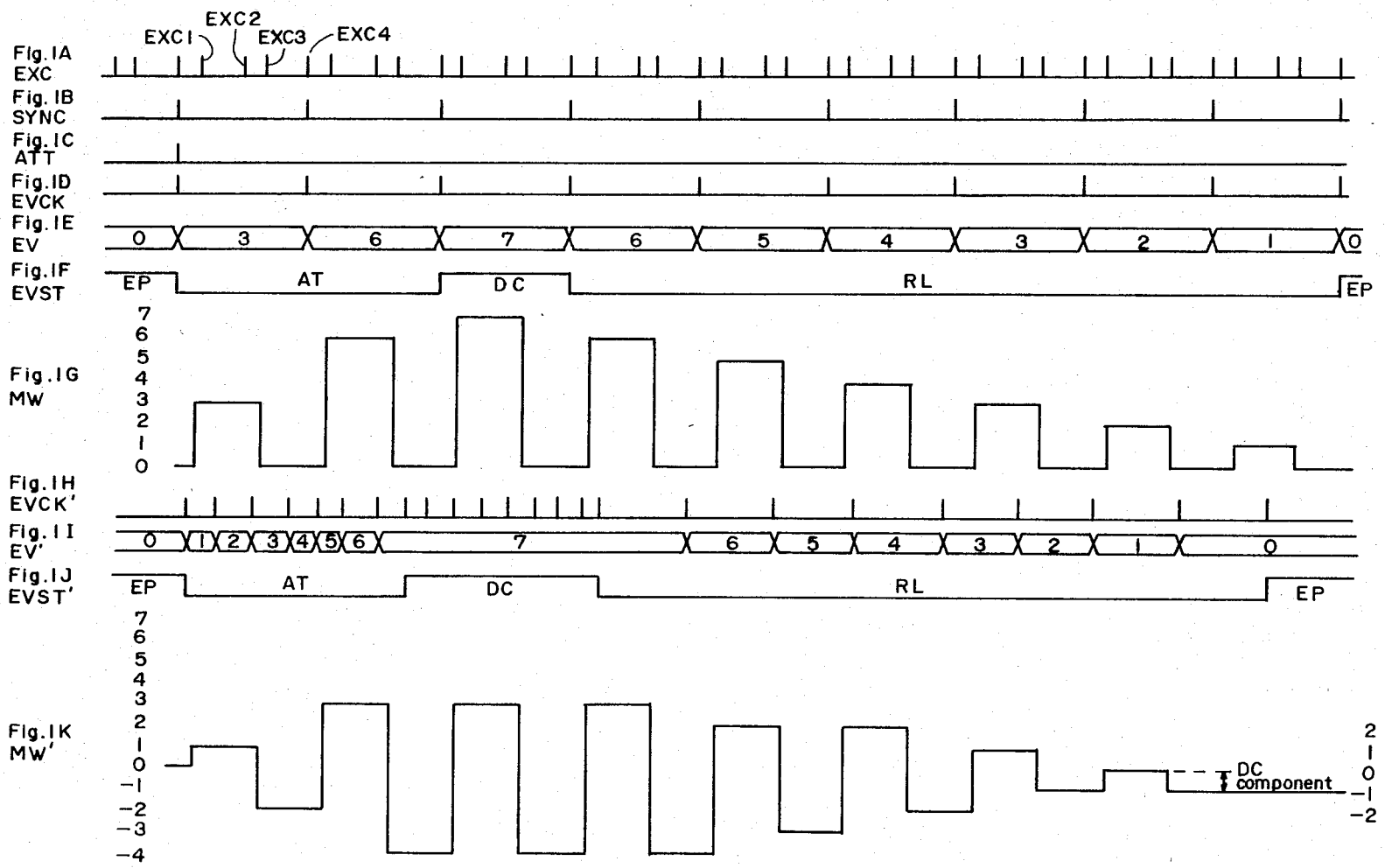
Fig.1A EXC
Fig.1B SYNC
Fig.1C ATT
Fig.1D EVCK
Fig.1E EV
Fig.1F EVST
Fig.1G MW
Fig.1H EVCK'
Fig.1I EV'
Fig.1J EVST'
Fig.1K MW'
EXC1
EXC2
EXC3
EXC4
EP
AT
DC
RL
DC component

+1
+1
−1
−1
0

2
1
0

3
2
1
0
−1
DC component

+1
+1
−1
−1
0

0
+1
+2
+1
0

2
1
0

4
3
2
1
0
STP

ADDER CIRCUIT 13
G2
COMPENSATION INHIBIT CIRCUIT 12
6
FA
6 bit FULL ADDER
OUTPUT OF AND
DIFFERENTIATED VALUE WAVEFORM MEMORY 9
SYNC
RL OF STATUS COUNTER 2

R1(R1')
AN1
I1
ATT
AN2
O1
SYNC
ATTON

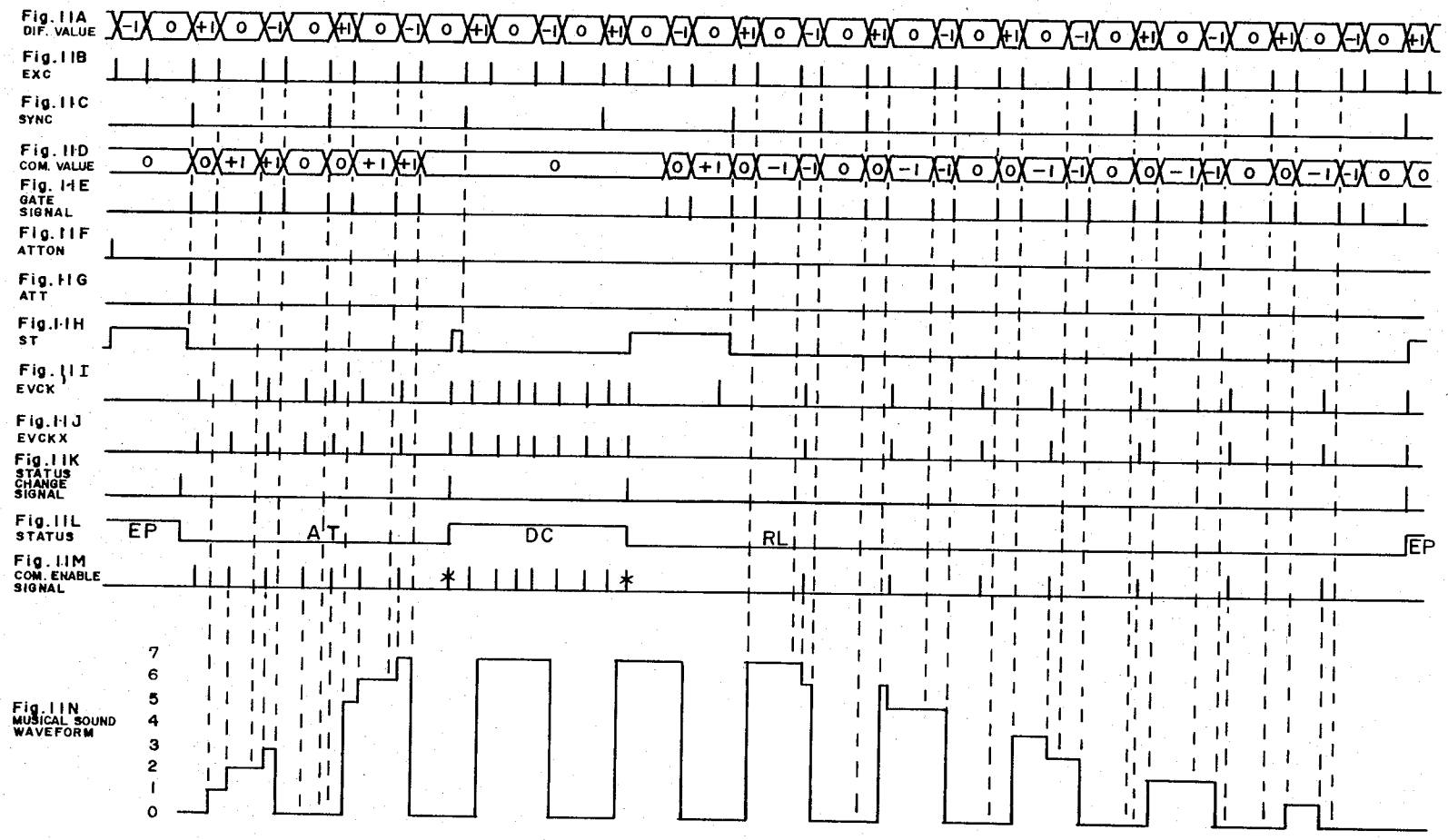
Fig.11A DIF. VALUE
Fig.11B EXC
Fig.11C SYNC
Fig.11D COM. VALUE
Fig.11E GATE SIGNAL
Fig.11F ATTON
Fig.11G ATT
Fig.11H ST
Fig.11I EVCK
Fig.11J EVCKX
Fig.11K STATUS CHANGE SIGNAL
Fig.11L STATUS
Fig.11M COM. ENABLE SIGNAL
Fig.11N MUSICAL SOUND WAVEFORM
EP
AT
DC
RL
EP
7
6
5
4
3
2
1
0

DIF. VALUE

EXC

SYNC

COM. VALUE

GATE SIGNAL

ATTON

ATT

ST

EVCK

EVCK'

STATUS CHANGE SIGNAL

EVST

COM. ENABLE SIGNAL

MUSICAL SOUND WAVEFORM
EP
DC
RL
EP
7
6
5
4
3
2
1
0

DIF. VALUE

EXC

SYNC

COM. VALUE

GATE SIGNAL

ATTON

ATT

ST

EVCK

EVCK'

STATUS CHANGE SIGNAL

EVST

COM. ENABLE SIGNAL

MUSICAL SOUND WAVEFORM
EP
RL
EP
7
6
5
4
3
2
1
0

ELECTRONIC MUSICAL INSTRUMENT

BACKGROUND OF THE INVENTION

The present invention relates to an electronic musical instrument which generates musical sounds by means of digital circuitry, and more particularly to an electronic musical instrument in which an envelope value is changed in asynchronism with a musical sound waveform.

As electronic technologies have rapidly progressed, it has become possible to generate sounds of musical instruments by electronic circuits. For example, an electronic piano generates the waveform of each sound of a piano by an electronic circuit, amplifies the waveform by an amplifier and emits the musical sound from a loudspeaker. Likewise, an electronic organ generates the waveform of a musical sound corresponding to a depressed key by an electronic circuit, amplifies the waveform by an amplifier and emits the musical sound from a loudspeaker.

Such electronic musical instrument generating the musical sound by electronic circuit assimilates this musical sound more to the sound to be produced from the acoustic musical instrument, by varying the envelope or the amplitude value of the sound with time. The musical sound is not emitted with its maximum value simultaneously with the depression of the key, but is produced as follows by way of example. First, an attack status is established, and the envelope value increases. When a specified value has been reached, a decay status is established, and the envelope value remains the specified value for a predetermined period of time. After the predetermined period of time, a release status is established, and the envelope value decreases slowly. The release status ends when the envelope value has become zero.

Meanwhile, the electronic musical instruments are classified into types which generates the musical sounds by analog processing, and types which generates them by digital processing.

The type based on analog processing is favorable in case of forming one sort of tone color, but its circuit arrangement becomes complicated in case of forming a plurality of kinds of tone colors. This is because the tone color of one musical instrument is produced by disposing a filter having a specified frequency characteristic. In order to emit a plurality of kinds of tone colors, a plurality of filters must be used. Further, a plurality of analog multiplier units are required for changing the envelopes independently of one another.

The type based on digital processing generates the waveform of the musical sound in terms of a digital value, and converts the digital value into an analog value by the use of a D/A (digital-to-analog) converter. A clock signal corresponding to the depressed key is generated, the pulses of the clock signal are counted by a counter, the count value is used for reading the content of a waveform memory in which waveform data are stored, and the digital data of the waveform is formed. The waveform data stored in the waveform memory are the differentiated values of the waveform, and the data read out from the waveform memory are accumulated for forming the digital data of the waveform.

The change of the envelope or amplitude in the digital processing is effected in such a way that the differentiation data of the waveform read out from the waveform memory is multiplied by the envelope value and that such results are accumulated.

While electronic musical instruments include the analog type and the digital type as stated above, most of them resort to digital processing at present because digital processing can be simply performed owing to the progress of the LSI technology.

Also the electronic musical instrument based on the digital processing performs the processing involving the attack, decay and release statuses described before. In the case of the digital processing, the accumulated result is not multiplied by the envelope value, but differentiation data of the waveform before the result is multiplied by the envelope value. In general, the envelope value is changed at the timing at which the cumulative value becomes zero.

FIGS. 1A to 1G show a timing chart depictive of the various timings of the electronic musical instrument in the foregoing case where the timing of the multiplication corresponds to the cumulative value of zero.

FIG. 1A shows the timing clock EXC of the waveform. This timing clock EXC of the waveform enters an address counter which appoints the address of a memory storing basic waveforms therein. By way of example, the address counter is a counter of 2 bits, which accesses the memory storing the differentiated values of the basic waveforms therein and causes it to deliver the corresponding differentiation data each time the timing clock EXC is inputted.

The waveforms shown in FIG. 1 will be explained below on the assumption that pulse-shaped waveforms are stored in the memory. More specifically, one waveform is composed of four clock pulses. The differentiation data of the basic waveform is "+1" at timing clock EXC1, "0" at timing clock EXC2, "−1" at timing clock EXC3, and "0" at timing clock EXC4. They are successively outputted from the memory.

FIG. 1B shows a synchronizing signal SYNC. An attack signal ATT (FIG. 1C), an envelope clock EVCK (FIG. 1D), an envelope value EV (FIG. 1E) and an envelope status EVST (FIG. 1F) change in synchronism with the synchronizing signal SYNC.

The attack signal ATT is a signal indicative of the start of the attack, and is delivered when a key is depressed. That is, the envelope status EVST becomes the attack AT in accordance with this signal. The envelope clock EVCK is a signal which affords the timing of the change of the envelope, and by which the envelope value EV is changed. The envelope value EV is 0 at the start of the attack, and becomes 3 simultaneously with the clock of the start. Therefore, the musical sound waveform MW (FIG. 1G) rises from 0 to 3 in accordance with the timing clock EXC1. The envelope value EV does not change at the timing clock EXC2, timing clock EXC3 and timing clock EXC4, and the differentiation data of the waveform is "−1" at the timing clock EXC3, so that the musical sound waveform MW changes from 3 to 0 again. At the next pulse of the synchronizing signal SYNC, the envelope value EV becomes 6, and the musical sound waveform MW becomes 6. At the still next pulse of the synchronizing signal SYNC, the envelope status EVST becomes the decay DC, and the envelope value EV becomes 7. The decay DC in FIG. 1F has a short duration, and changes into the release RL at the next clock. In the release RL, the envelope value EV changes to be 6, 5, 4, 3, 2 and 1 at the successive pulses of the synchronizing signal SYNC. Finally, the release RL ends, that is, the amplitude becomes 0.

In the case of FIGS. 1A to 1G, the envelope value EV is always changed when the value of the waveform, namely, the cumulative value becomes 0. Thus, the cumulative value finally becomes 0 without fail. Since this method changes the envelope value EV in synchronism with one cycle of the musical sound or one waveform, only one timing for changing the envelope value EV exists within one cycle. Therefore, the method cannot change the envelope value EV, e. g., from 0 to 7 slowly and greatly within one cycle, in other words, to be 0, 1, 2, . . . and 7 within one cycle, and it can afford only such great changes of the envelope as being 0, 4 and 7 in succession. In the example of FIG. 1, the envelope value is changed to be 3 and 6 in two cycles. This results in increasing the varying width of the envelope, and is equivalent to decreasing the apparent number of bits of the envelope. Accordingly, the prior art involves the problems of the occurrence of clock noise, etc., which lead to musical sounds offensive to the ears.

On the other hand, to the end of solving the problems, there has been proposed a method in which the envelope value EV is changed without being synchronized to the synchronizing signal SYNC.

FIGS. 1H to 1K show a timing chart of the system which changes the envelope in asynchronism with the synchronizing signal SYNC. The timing clock EXC, synchronizing signal SYNC and attack signal ATT in this case are the same as those in the foregoing case, and reference should be had to FIGS. 1A to 1C. In this system, an envelope clock EVCK' and an envelope value EV' change in asynchronism with the synchronizing signal SYNC. By way of example, simultaneously with the attack signal ATT, an envelope status EVST' becomes the attack AT, and the envelope value EV' becomes 1 in accordance with the envelope clock EVCK'. Since, at this time, the timing clock EXC1 is +1, a musical sound waveform MW' changes from 0 to 1. Subsequently, irrespective of the synchronizing signal SYNC, the envelope clock EVCK' is outputted, and the envelope value EV' becomes 2. Although the timing clock EXC2 exists meantime, the musical sound waveform MW' at this timing does not change because the basic waveform data is 0. The reason is that the basic waveform data of this system are differentiated values, and that the musical sound waveform MW' is obtained by multiplying the basic waveform data by the envelope value and accumulating such products. The envelope value EV' becomes 3 at the same time as the next envelope clock EVCK'. Since, however, the timing clock EXC is not outputted yet at this point of time, the musical sound waveform MW' does not change. The change is effected by the timing clock EXC3. This is because the basic waveform data is −1 at the timing clock EXC3. That is, the basic waveform data and the envelope value EV' are multiplied and the product is cumulated in response to the timing clock EXC3. As a result, the musical sound waveform MW' becomes −2. Likewise, the envelope value EV' is successively changed to be 4, 5, 6 and 7 by the envelope clock signal EVCK', and the envelope status EVST' becomes the decay DC. Thus, the musical sound waveform MW' changes from −2 to be +3, −4, +3 . . . Further, the envelope status EVST' changes from the decay DC into the release RL, and the envelope value EV' decreases to be 6, 5, 4 . . . and finally becomes 0. When the envelope status EVST' is the release RL, the duration of the envelope clock EVCK' is long, with the result that the musical sound waveform MW' decreases slowly. The above operations are repeated in succession. With this system, the musical sound waveform MW' does not become 0 in some cases in spite of the fact that the envelope value EV' has finally become 0, whereupon the release RL has become 0. The musical sound waveform MW' shown in FIG. 1K is −1 at this time.

With the system wherein the absolute value of the musical sound waveform is obtained in the final accumulation part as stated above, a DC (direct current) component is left behind when the envelope value has been changed at any other time than the time at which the cumulative value becomes 0. When the operations of depressing keys and generating musical sounds have been successively repeated, the DC component becomes large and sometimes exceeds the dynamic range of the D/A converter. Due to the presence of the DC component, the cone of the speaker does not oscillate at a predetermined position, and it recedes deep or bulges frontwards. In this manner, several problems are involved in the system which change the envelope value asynchronously.

SUMMARY OF THE INVENTION

The present invention has solved the problems mentioned above, and has for its object to provide an electronic musical instrument which is free from the residual DC component in the asynchronous system and in which the envelope value can be finely varied even in, e. g., the attack status.

Another object of the present invention is to provide an electronic musical instrument which skips at least one of the envelope statuses and which generates musical sound waveforms of various tone colors.

Still another object of the present invention is to provide an electronic musical instrument which can generate a plurality of musical sounds at the same time and can finely change the envelope value without the residual DC component.

The characterizing features of the present invention are listed below.

The differentiation data of a basic waveform is read out at the timing of a clock corresponding to the musical scale of an operated play key, and it is multiplied by an envelope value so as to form a musical sound waveform differentiation value. In parallel therewith, the differentiation data is accumulated at the aforementioned timing so as to form a compensative value. The compensative value is added with the musical sound waveform differentiation value so as to cancel a DC component which develops in a musical sound waveform. The musical sound waveform differentiation values thus compensated are accumulated, and are subjected to digital-to-analog conversion, so that a musical sound waveform free from a DC component is produced.

BRIEF DESCRIPTION OF THE DRAWINGS

FIGS. 1A to 1K show timing charts of prior-art electronic musical instruments, in which FIG. 1A shows a timing clock, FIG. 1B a synchronizing signal, FIG. 1C an attack signal, FIG. 1D and FIG. 1H envelope clocks. FIG. 1E and FIG. 1I envelope values, FIG. 1F and FIG. 1J envelope statuses, and FIG. 1G and FIG. 1K musical sound waveforms;

FIGS. 11A–11N, 12A–12N and 13A–13N are timing charts of the electronic musical instruments of the present invention, in which FIG. 11A, 12A and 13A show waveform differentiation values, FIG. 11B, 12B and 13B a timing clock, FIG. 11C, 12C and 13C a synchronizing signal, FIG. 11D, 12D and 13D compensative values, FIG. 11E, 12E and 13E a gate signal, FIG. 11F, 12F and 13F an attack-on signal, FIG. 11G, 12G and 13G an attack signal, FIG. 11H, 12H and 13H a control signal specifying whether or not an envelope clock is provided, FIG. 11I, 12I, 13I, 11J, 12J and 13J the envelope clocks, FIG. 11K, 12K and 13K a status change signal, FIG. 11L, 12L and 13L an envelope status, FIG. 11M, 12M and 13M a compensation enable signal, and FIG. 11N, 12N and 13N a musical sound waveform.

DETAILED DESCRIPTION OF THE INVENTION

With the prior-art system described before, after the envelope value has changed, the multiplication with a new envelope value and the subsequent accumulation are properly executed. However, values already outputted or already accumulation have been based on older envelope values, and the accumulation of the multiplication results between these values and the new envelope value incurs a DC component as stated before. According to the present invention, a compensative value is added to the older cumulative value, to make corrections so as to gain a cumulative value based on the new envelope value.

The DC component value Er is expressed as a function of the differentiated value Δ of the waveform, the envelope value n before the change and the envelope value 0 after the change, as follows:

$$-Er=(n-0)\,\Sigma\Delta \qquad (1)$$

Assuming here that the envelope value changes by only ±1 with respect to the envelope clock EVCK, the following holds:

$$-Er=\pm\Sigma\Delta \qquad (2)$$

Thus, the present invention is based on the principle that ΣΔ is evaluated in advance by supposing the change of the envelope value to be ±1 with respect to the envelope clock EVCK, and that when the envelope value has changed, the value ΣΔ at this time is added as the compensative value so as to make the corrections.

FIGS. 2 and 3 show a waveform diagram of the prior-art system and a waveform diagram of the present invention, respectively.

Figures 2A, 2B, 2C, 2D, 3A, 3B, 3C, 3D, 3E:
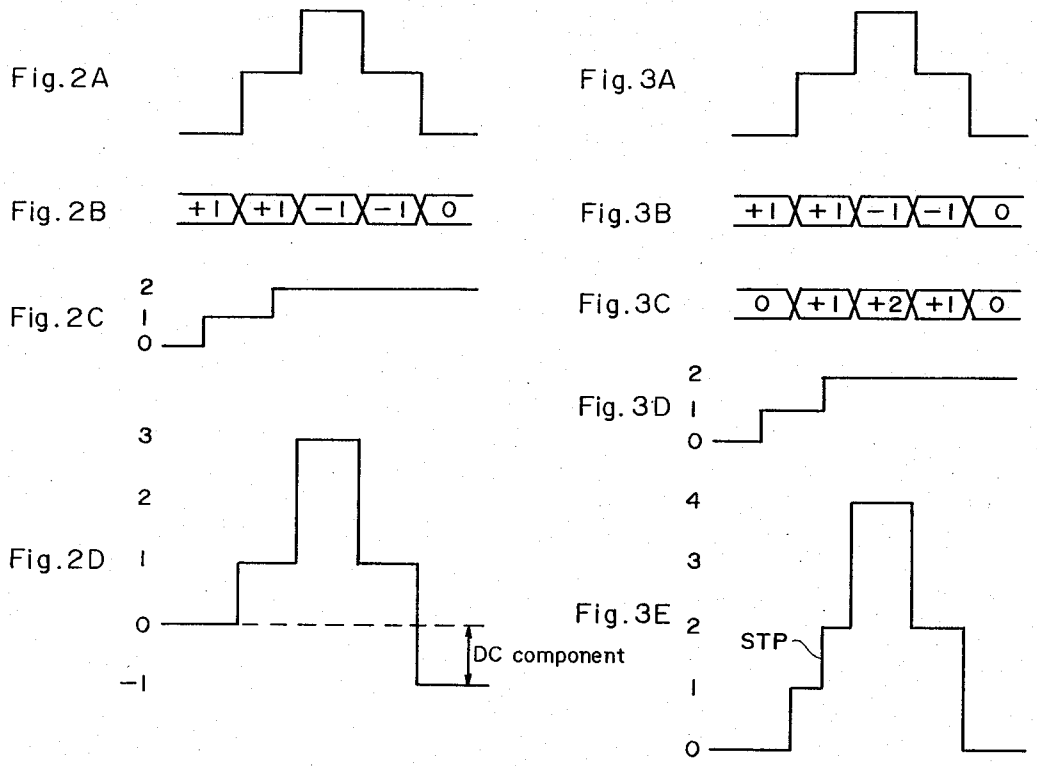
FIGS. 2A–D are basic waveform diagrams of the prior-art electronic musical instrument.
FIGS. 3A–E are basic waveform diagrams of an electronic musical instrument according to the present invention.

FIGS. 2B and 3B show waveform data, while FIGS. 2A and 3A show the cumulative values of the data values, namely, musical sound waveforms at the time at which the envelope value is 1. FIG. 3C shows digital values at that time. These values are the aforementioned ΣΔ. When the envelope values have changed as shown in FIGS. 2C and 3D, the corresponding musical sound waveforms become as depicted in FIGS. 2D and 3E, respectively.

As seen from FIG. 2D, a DC component remains in the final value in the prior-art system. In contrast, as seen from FIG. 3E, such DC component is compensated in the present invention. This is because, when the envelope value has changed asynchronously, the value ΣΔ at that time is added for the compensation. A step indicated at STP in FIG. 3E is the step based on the compensation.

Figure 4:
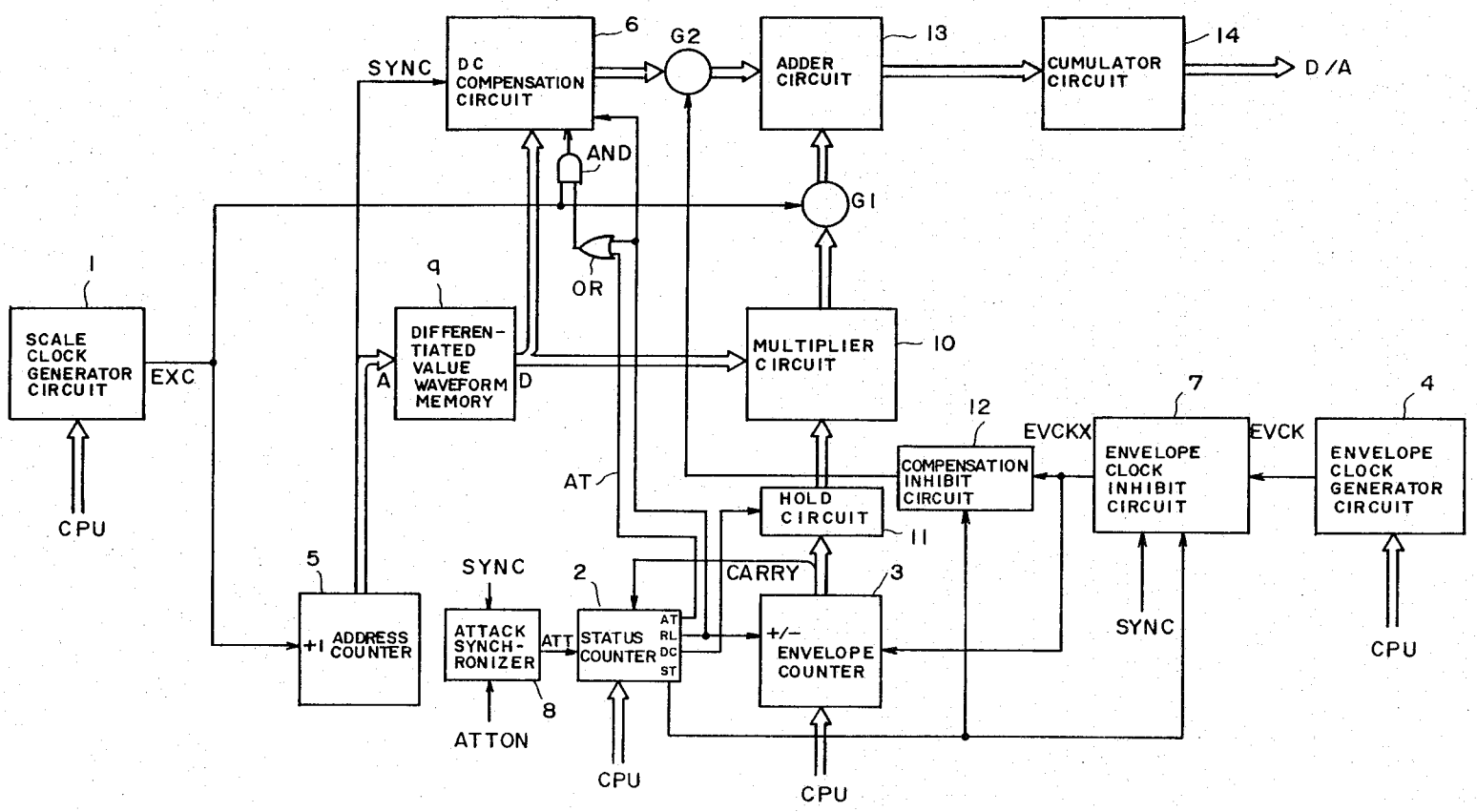
FIG. 4 is a circuit arrangement diagram of an embodiment of the present invention.

FIG. 4 shows a circuit arrangement diagram of an embodiment of the present invention. The abbreviated expressions of symbols are the same as in FIG. 1A to 1K. A musical scale clock generator circuit 1, a status counter 2, an envelope counter 3 and an envelope clock generator circuit 4 are connected to a processor CPU. The output EXC of the scale clock generator circuit 1 is applied to the input terminal of a gate circuit G1, the first input terminal of an AND circuit AND and the +1 input terminal of an address counter 5. The SYNC output of the address counter 5 is applied to the SYNC input terminals of a DC (direct current) compensation circuit 6, an envelope clock inhibit circuit 7 and an attack synchronizer 8. The lines of connection for the signal SYNC entering the attack synchronizer 8 and the envelope clock inhibit circuit 7 are omitted from the drawing. The address output terminals of the address counter 5 are connected to the address terminals A of a differentiated value waveform memory 9. The output D of the waveform memory 9 is applied to a multiplier circuit 10 and the DC compensation circuit 6. The attack synchronizer 8 is further supplied with an attack-on signal ATTON, and its output is applied to the status counter 2. The AT output terminal of the status counter 2 is connected to the first input terminal of an OR circuit OR. The RL (release) output terminal of the status counter 2 is connected to the second input terminal of the OR circuit OR and also to the DC compensation circuit 6 and envelope counter 3. The output of the OR circuit OR is applied to the second input terminal of the AND circuit AND, the output of which is applied to the DC compensation circuit 6. The DC output terminal of the status counter 2 is connected to the hold terminal of a hold circuit 11, and the stop signal ST terminal thereof to the envelope clock inhibit circuit 7 and a compensation inhibit circuit 12. Compensative data from the DC compensation circuit 6 are applied to the first addition input terminals of an adder circuit 13 through a gate circuit G2. The output of the envelope counter 3 is applied to the second addition input terminals of the adder circuit 13 through the hold circuit 11, multiplier circuit 10 and gate circuit G1. In addition, the carry output of the envelope counter 3 is applied to the status counter 2. The envelope clock of the envelope clock generator circuit 4 is applied to the envelope clock inhibit circuit 7, the output of which is applied to the envelope counter 3 and compensation inhibit circuit 12. The envelope clock output of the compensation inhibit circuit 12 enters the gate input of the gate circuit G2. The output of the adder circuit 13 is applied to a cumulator circuit 14. The output of the cumulator circuit 14 is applied to a digital-to-analog converter D/A not shown in FIG. 4.

The whole circuit shown in FIG. 4 operates at the timings of a system clock $\phi$s.

The operations of the embodiment of the present invention will now be described with reference to a timing chart shown in FIG. 11A to 11N.

The signal of a depressed key is detected by the processor CPU, and data corresponding to the depressed key is inputted to the musical scale clock generator circuit 1. A clock corresponding to the data, namely, a timing clock EXC (FIG. 11B) is produced in the scale clock generator circuit 1, and it increments the data of the address counter 5. The data of the address counter 5 is successively incremented in accordance with the timing clock EXC, to access the address A of the differentiated value waveform memory 9. The address counter 5 is a counter of 2 bits. It generates a carry signal every fourth pulse of the timing clock EXC, and this signal becomes the synchronizing signal SYNC (FIG. 11C). The differentiated value waveform memory 9 delivers as its output the data of a memory area appointed by the address counter 5. Data (FIG. 11A) stored in the differentiated value waveform memory 9 are differentiated values of musical sounds, and they are inputted to the DC compensation circuit 6 and the multiplier circuit 10. The attack synchronizer 8 receives the attack-on signal ATTON (FIG. 11F), and supplies an attack signal ATT (FIG. 11G) to the status counter 2 in synchronism with the next pulse of the synchronizing signal SYNC. The status counter 2 counts the carry output of the envelope counter 3, namely, a status change signal (FIG. 11K) so as to provide status signals of attack AT, decay DC and release RL. FIG. 11L shows the respective statuses at AT, DC and RL. EP in the figure indicates a status which does not belong to the aforementioned statuses, and it signifies that the status counter 2 is empty. In addition, the status counter 2 provides a stop signal ST as its output. This signal enters the envelope clock inhibit circuit 7, and becomes a control signal (FIG. 11H) to determine whether or not an envelope clock is delivered. The envelope clock generator circuit 4 is a circuit for producing the envelope clock EVCK. It supplies the envelope clock inhibit circuit 7 with the envelope clock EVCK (FIG. 11I) appointed by the processor CPU. Depending upon the stop signal ST generated by the status counter 2, the envelope clock inhibit circuit 7 determines whether or not the envelope clock EVCK generated by the envelope clock generator circuit 4 is inhibited. FIG. 11J shows the signal EVCKX of the inhibit circuit 7, and this signal is applied to the envelope counter 3. The envelope counter 3 is a circuit which forms an envelope waveform under the instruction of the processor CPU. It begins to count the pulses of the signal EVCKX simultaneously with the provision of the attack AT. It also counts the pulses of the signal EVCKX at the decay DC. The release RL of the status counter 2 is applied to the +/− terminal of the envelope counter 3. At the release RL, the envelope counter 3 performs the operation of decrementing from the maximum envelope value conversely to the above. The output of the envelope counter 3 is applied to the hold circuit 11, and it passes through this hold circuit 11 and enters the multiplier circuit 10 at the attack AT and release RL. At the decay DC, the maximum value of the envelope counter 3, namely, the final value of the attack AT is held by the hold circuit 11 and then applied to the multiplier circuit 10. The hold circuit 11 is a circuit for holding the maximum value of the envelope at the decay DC. That is, since the envelope counter 3 performs counting even during the decay DC, the hold circuit 11 prevents the count value from entering the multiplier circuit 10. The multiplier circuit 10 is a circuit for multiplying the data of the differentiated value waveform memory 9 and the data of the hold circuit 11, and it delivers the differentiated value of a musical sound waveform corresponding to the envelope value. The delivered value enters the adder circuit 13 through the gate circuit G1. Since the gate of the gate circuit G1 is turned "on" by the timing clock EXC, the value is inputted to the adder circuit 13 at the timing of the timing clock EXC.

Further, the OR circuit OR obtains the logic OR of the statuses of the attack AT and the release RL. When the status is either the attack AT or the release RL, the OR circuit OR turns "on" the gate of the AND circuit AND so as to supply the DC compensation circuit 6 with the timing clock signal EXC (FIG. 11E). This is because no compensation is necessary at the decay DC, and compensative values are obtained only at the attack AT and the release RL. The DC compensation circuit 6 is also supplied with the synchronizing signal SYNC. This is intended to clear the content of the DC compensation circuit 6 at the same time that the content of the address counter 5 has become zero. More specifically, only when the status is the attack AT or the release RL, the DC compensation circuit 6 accumulates the data provided from the differentiated value waveform memory 9 and applies the value to the adder circuit 13 through the gate circuit G2. The accumulation is executed with the timing clock EXC, and the DC compensation circuit 6 is continually cleared every cycle of a musical sound by the synchronizing signal SYNC. FIG. 11D shows the compensative values of the DC compensation circuit 6.

In the present invention, the compensation must not be made at the point of time at which the status changes. It is the compensation inhibit circuit 12 and the gate circuit G2 that inhibit the compensation. The compensation inhibit circuit 12 does not provide the signal EVCKX when the stop signal ST supplied from the status counter 2 is at its high (H) level, and it provides the same when the stop signal ST is at its low (L) level. The output of the compensation inhibit circuit 12 enters the gate circuit G2, and controls whether or not the compensative value of the DC compensation circuit 6 is applied to the adder circuit 13. That is, only when the gate circuit G2 is supplied with the clock from the compensation inhibit circuit 12, its gate is turned "on" to apply the compensative value of the DC compensation circuit 6 to the adder circuit 13. The adder circuit 13 adds the differentiated value of the musical sound and the compensative value of the DC compensation circuit 6 which are relevant to the envelope value and which have been inputted through the gate circuits G1 and G2. It delivers the resulting sum to the cumulator circuit 14. The output of the adder circuit 13 is the sum between the differentiated value and compensative value of the musical sound corresponding to each clock, and such sum values are accumulated by the cumulator circuit 14. The output of the embodiment of the present invention in FIG. 4 is applied to the digital-to-analog converter D/A. The resulting analog signal is provided as musical sound by a speaker, not shown, through an amplifier, not shown. FIG. 11N shows the output waveform of the digital-to-analog converter circuit. As apparent from this waveform, there is no change in the DC component.

Figure 5:
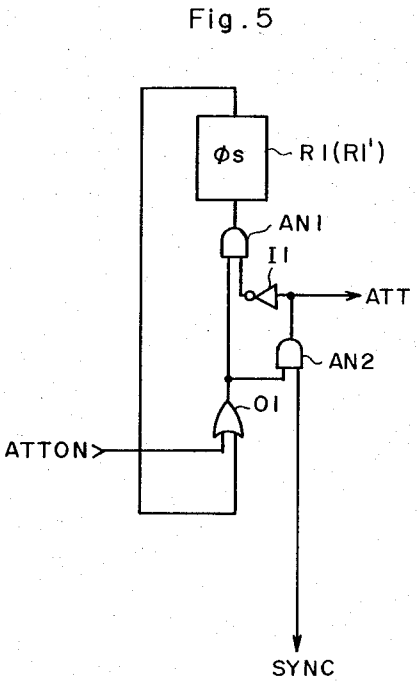
FIG. 5 is a circuit arrangement diagram of an attack synchronizer in the embodiment of FIG. 4.

FIG. 5 shows a circuit diagram of the attack synchronizer 8. The attack-on signal ATTON enters an OR circuit 01, the output of which enters one input of each of AND circuits AN1 and AN2. The output of the AND circuit AN1 enters the OR circuit 01 through a register R1. Meanwhile, the synchronizing signal SYNC enters the other input of the AND circuit AN2, the output of which is delivered to the status counter 2 as the attack signal ATT and is also applied to the other input of the AND circuit AN1 through an inverter I1. The OR circuit 01, AND circuit AN1 and register R1 form a loop, in which the attack-on signal ATTON is stored. More specifically, when the attack-on signal ATTON has been received, the loop becomes its "H" level to turn "on" the AND gate circuit AN2. As a result, the next pulse of the synchronizing signal SYNC is delivered as the attack signal ATT through the AND circuit AN2 and is also applied to the AND circuit AN1 through the inverter I1, to bring the level of the loop to the "L" level thereof. In other words, the attack synchronizer 8 is a circuit for providing the attack signal ATT in synchronism with the synchronizing signal SYNC. The attack-on signal ATTON is stored in the loop circuit composed of the OR circuit 01, AND circuit AN1 and register R1. The synchronizing signal SYNC inputted after the storage is provided as the attack signal ATT, and simultaneously, the storage of the loop or the "H" level is reset.

Figure 6:
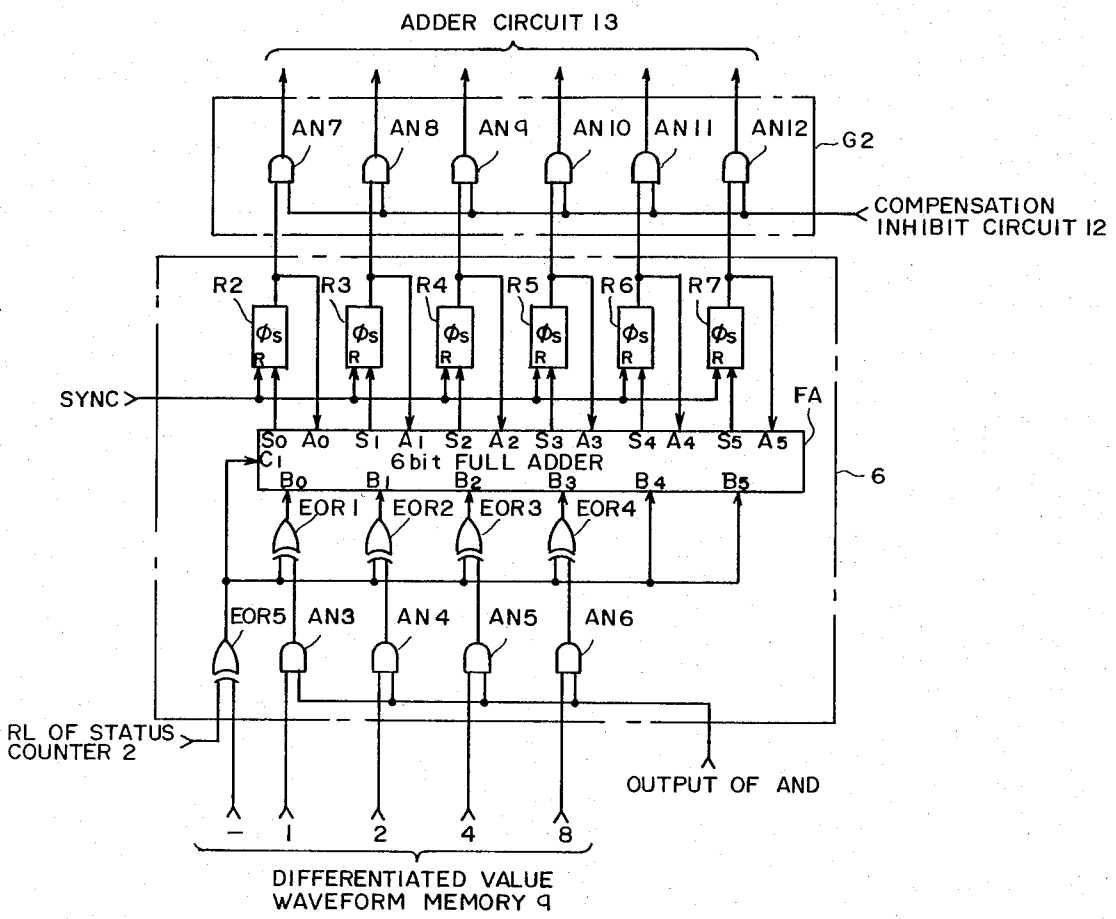
FIG. 6 is a circuit arrangement diagram of a DC compensation circuit as well as a gate circuit in FIG. 4.

FIG. 6 shows circuit diagrams of the DC compensation circuit 6 and the gate circuit G2. The output of the AND circuit AND is applied to the first gates of AND circuits AN3–AN6 in common. The differentiated values from the differentiated value waveform memory 9 are applied to the second gates of the respective AND circuits AN3–AN6. The outputs of the AND circuits AN3–AN6 are applied to the addend inputs $B_0$–$B_3$ of a full adder FA of six bits through exclusive-or circuits EOR1–EOR4, respectively. Moreover other hand, the release signal RL of the status counter 2 and the minus signal of the differentiated value waveform memory 9 are applied to an exclusive-or circuit EOR5, the output signal of which is applied to the carry input $C_i$ of the full adder FA, the exclusive-or circuits EOR1–EOR 4 and the addend inputs $B_4$ and $B_5$ of the full adder FA. The synchronizing signal SYNC is applied to the reset terminals of registers R2–R7. The sum signals $S_0$–$S_5$ of the full adder FA are respectively applied to the input terminals of the registers R2–R7, the outputs of which are respectively connected to the gates of AND circuits AN7–AN12 and the augend inputs $A_0$–$A_5$ of the full adder FA. The output of the compensation inhibit circuit 12 is connected to the other gates of the AND circuits AN7–AN12 in common, and the outputs of these AND circuits are applied to the adder circuit 13. The AND circuits AN7–AN12 constitute the gate circuit G2 in FIG. 4. When the AND circuits AN3–AN6 are turned "on" by the timing clock EXC inputted through the AND circuit AND, the signals inputted from the differentiated value waveform memory 9 are respectively passed through the exclusive-or circuits EOR1–EOR4 and then added with values, stored in the registers R2–R7, by the full adder FA. The results are respectively delivered as the sum signals $S_0$–$S_5$ and stored in the registers $R_2$–$R_7$ again. The output of the exclusive-or circuit EOR5 is a signal which specifies addition or subtraction. When it is at its "H" level, a subtracting operation is conducted, and when it is at its "L" level, an adding operation is conducted. The full adder FA is an adder, but two's complements are formed under some conditions owing to the exclusive-or circuits EOR1–EOR4 which are respectively connected to the addend inputs $B_0$–$B_3$. In this case, a subtraction is conducted. Since the compensative values are opposite in sign between the statuses of the attack AT and the release RL, the exclusive-or circuit EOR5 determines the processing in accordance with the exclusive OR between the release RL of the status counter 2 and the data of the differentiated value waveform memory 9. More specifically, when the status is the release RL, the output of the exclusive-or circuit EOR5 becomes the addition signal for the minus data of the differentiated value waveform memory 9, and it becomes the subtraction signal for the plus data. When the status is not the release RL, the output of the circuit EOR5 becomes the subtraction signal for the minus data of the differentiated value waveform memory 9, and it becomes the addition signal for the plus data. The registers R2–R7 in which the added result of the full adder FA is stored have the musical sound waveform value at the time at which the envelope value is 1, and the sign of the waveform value is the opposite at the release RL as stated before. The synchronizing signal SYNC applied to the reset terminals of the registers R2–R7 serves to reset these registers every cycle of the musical sound. That is, the data to be stored in the registers R2–R7 have the opposite plus and minus directions in accordance with the statuses, and they are synchronized by the synchronizing signal SYNC. In other words, in the present invention, the synchronizing signal SYNC represents the start of one cycle of the waveform. The waveform value at that time is zero, so that even when a DC component has arisen due to, e. g., an error, it is cleared every cycle by the synchronizing signal.

Figure 7:
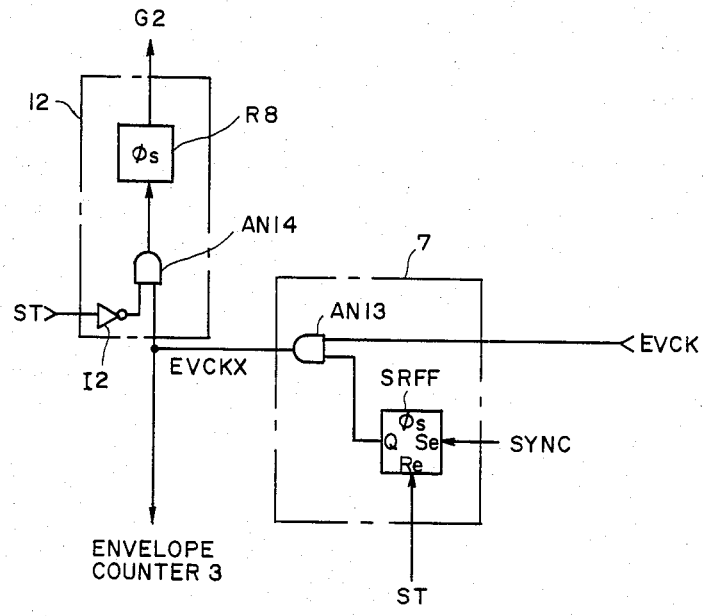
FIG. 7 is a circuit arrangement diagram of an envelope clock inhibit circuit as well as a compensation inhibit circuit in FIG. 4.

FIG. 7 shows circuit diagrams of the envelope clock inhibit circuit 7 and the compensation inhibit circuit 12. The envelope clock EVCK of the envelope clock generator circuit 4 enters the first input of an AND circuit AN13. The synchronizing signal SYNC enters the set terminal Se of a set/reset flip-flop SRFF, the output Q of which enters the second input of the AND circuit AN13. The output of the AND circuit AN13, namely, the signal EVCKX enters the envelope counter 3 and an AND circuit AN14 constituting the compensation inhibit circuit 12. The AND circuit AN14 is also supplied with the stop signal ST through an inverter I2, and its output enters the gate circuit G2 through a register R8. Upon receiving the stop signal ST, the set/reset flip-flop SRFF is reset, so that the envelope clock EVCK entering the AND circuit AN13 fails to be delivered. Upon receiving the synchronizing signal SYNC after the stop signal ST, the set/reset flip-flop SRFF is set to provide an output of "H" level, so that the AND circuit AN13 is turned "on" to deliver the envelope clock EVCK. The delivered signal is the signal EVCKX, which enters the envelope counter 3 as well as the AND circuit AN14. The set/reset flip-flop SRFF operates by the system clock $\phi_s$, and even when the stop signal ST is applied thereto, the set/reset flip-flop SRFF is not reset until a clock pulse of the system clock $\phi_S$ is applied thereto. Therefore, the envelope clock EVCK at that time is delivered through the AND circuit AN13. It is the compensation inhibit circuit 12 that inhibits the envelope clock EVCK at this time. The AND circuit AN14 is turned "off" by the inverted signal of the stop signal ST, and the register R8 is not supplied with the signal EVCKX at this time. As a result, the output of the register R8 becomes its "L" level in response to the system clock $\phi_S$, to turn "off" the gate of the gate circuit G2. Thus, the compensative output of the DC compensation circuit 6 is prevented from entering the adder circuit 13, and the compensation is inhibited. FIG. 11M shows a compensation enable signal which is applied to the gate circuit G2. Clock pulses marked x in this figure are inhibited by the compensation inhibit circuit 12.

Now, timing charts shown in FIGS. 12A–12N and 13A–13N will be referred to.

The timing charts of FIGS. 11A–11N correspond to the case where the envelope status EVST changes to be the attack AT, decay DC and release RL. In contrast, FIGS. 12A–12N correspond to a case where the status of the attack AT does not exist, and FIG. 13A–13N a case where neither the status of the attack AT nor the status of the decay DC exists.

As already stated, not only the tone color but also the time variation of an envelope need to be considered in order that a musical sound to be produced may be assimilated more to the musical sound of an acoustic musical instrument. In case of comparing the sounds of a violin and a guitar by way of example, the envelope value of the former increases gradually, whereas the envelope value of the latter decreases rapidly after becoming the maximum value the instant that a string has been touched. In this manner, both the musical sounds differ in the envelope variation besides in the tone color.

With this point taken into account, the present embodiment makes it possible to produce a musical sound by skipping the attack AT or/and the decay DC among the envelope statuses.

A plurality of sorts of clocks corresponding to the respective envelope statuses are stored in the envelope clock generator circuit 4 in advance, and any of them is selected by the processor CPU so as to be delivered as the envelope clock EVCK. Accordingly, in the case of generating the musical sound waveform of a guitar by way of example, the processor CPU can select the release status as the envelope clock EVCK from the beginning by skipping the envelope statuses of the attack and decay. At that time, the processor CPU controls also the status counter 2 and the envelope counter 3 so that the former 2 may provide its output signal from the release terminal RL and that the latter 3 may set the envelope value at the maximum value 7. In accordance with the RL signal from the status counter 2, the envelope counter 3 counts down the envelope value 7 at the timing of the clock EVCKX. Thus, the waveform with the attack and decay omitted can be produced. Operations in the case of omitting only the attack are similar.

Figures 12A, 12B, 12C, 12D, 12E, 12F, 12G, 12H, 12I, 12J, 12K, 12L, 12M, 12N:
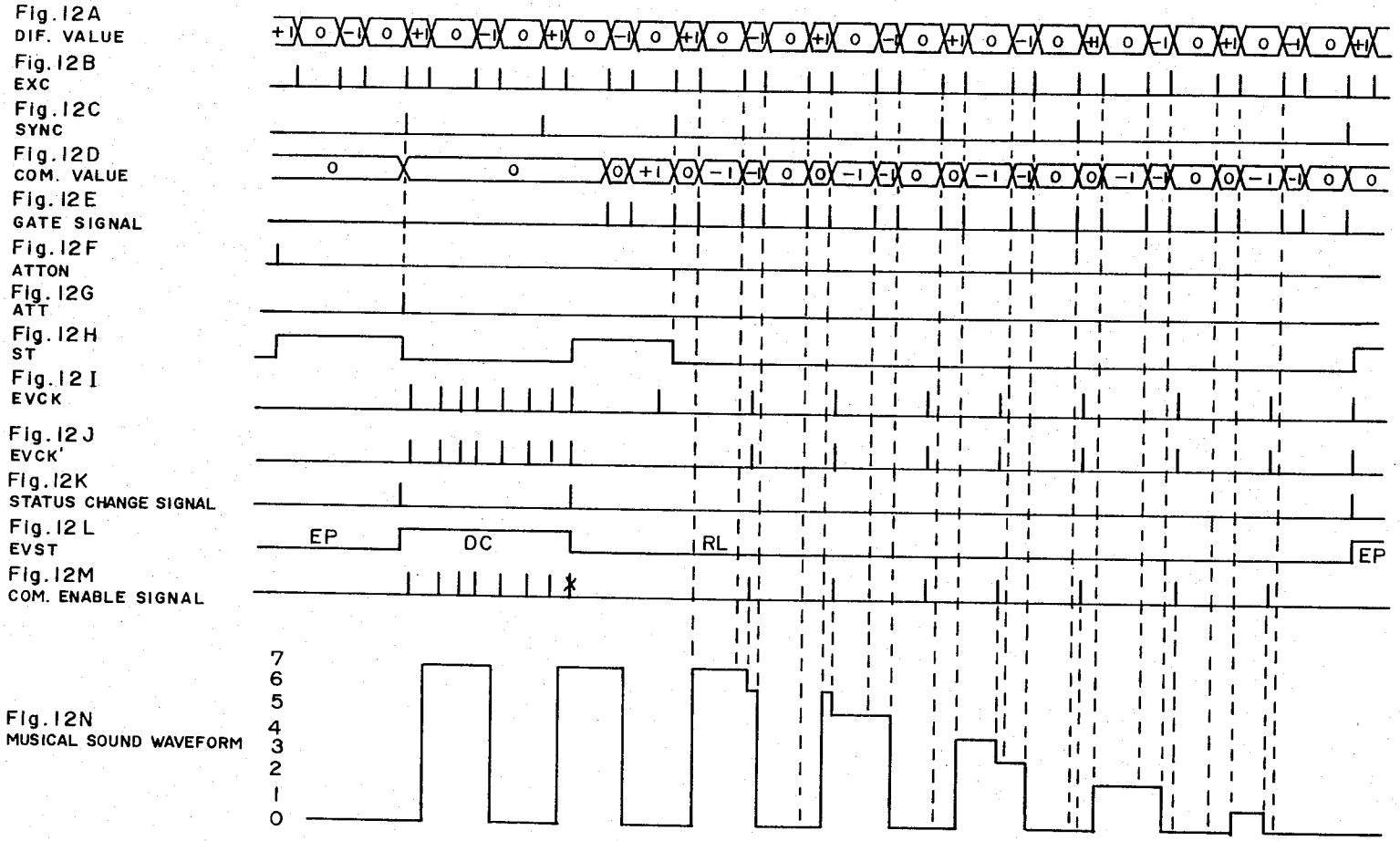

In the illustration of the timing chart of FIG. 12A–12N, when the attack-on signal ATTON has been received, the attack synchronizer 8 generates the attack signal ATT in synchronism with the synchronizing signal SYNC. Owing to the attack signal, the envelope status EVST becomes the decay DC, and the amplitude of the output waveform becomes 7. The maximum of the envelope value EV is assumed 7 in FIGS. 11A–11N, 12A–12N and 13A–13N. Since the envelope value EV before the change of the status in zero, the compensation is unnecessary at this time. Since the amplitude does not change during the decay DC, the compensation is inhibited. Next, the status changes from the decay DC into the release RL, in which the compensation is made. Each time the envelope value EV changes in asynchronism with the synchronizing signal SYNC, the compensative value is subtracted from the waveform value.

Figures 13A, 13B, 13C, 13D, 13E, 13F, 13G, 13H, 13I, 13J, 13K, 13L, 13M, 13N:
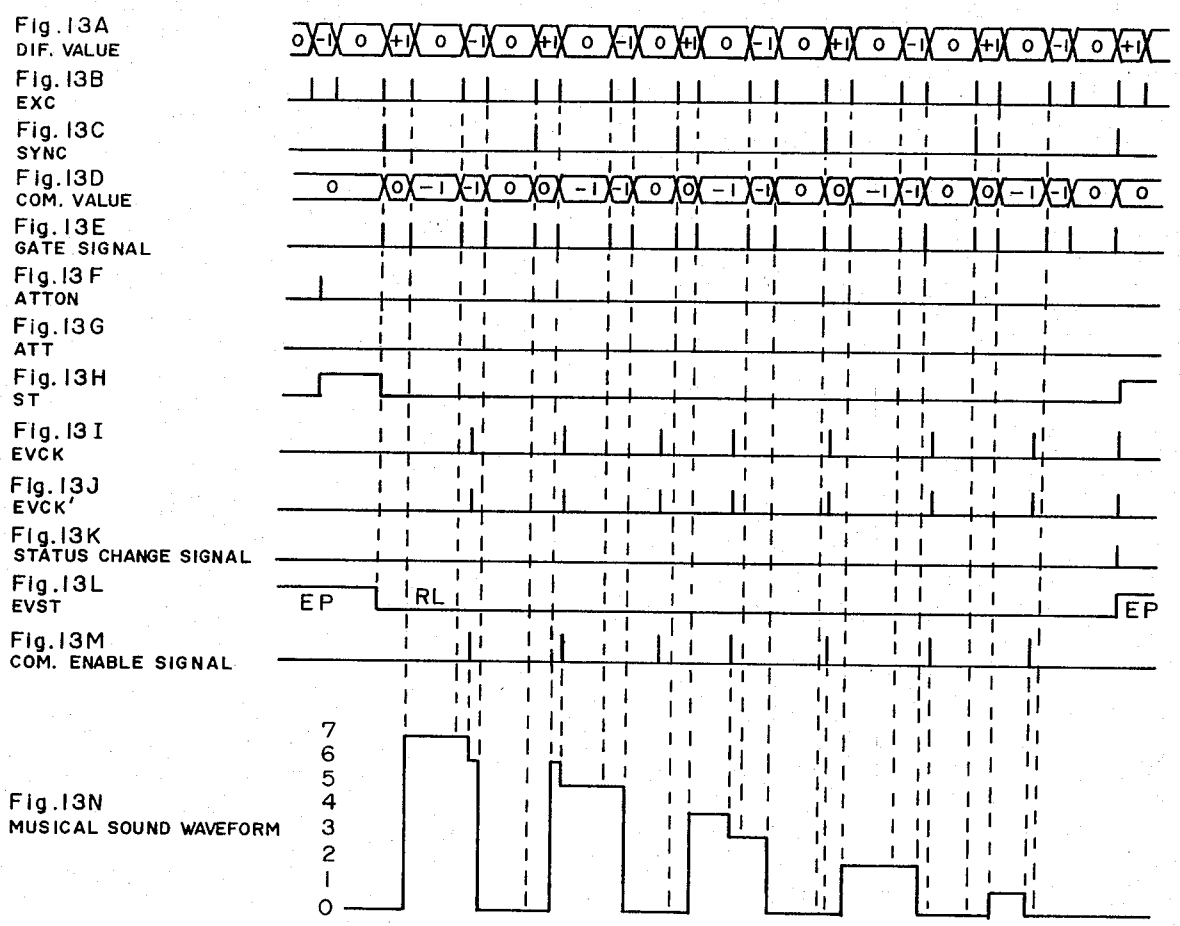

Operations in FIG. 13A–13N are similar to those in FIGS. 12A–12N. In the illustration of FIG. 13A–13N, however, the attack AT and decay DC are nonexistent, and the status starts from the release RL. More specifically, when the attack-on signal ATTON has been inputted, the attack signal ATT is generated from the attack synchronizer 8 in synchronism with the synchronizing signal SYNC. Owing to this attack signal, the envelope status EVST becomes the release RL, and the amplitude of the output waveform becomes 7. Since, however, the current status is the release RL, the compensative value is subtracted from the waveform value each time the envelope value EV changes in asynchronism with the synchronizing signal SYNC.

Referring now to FIGS. 8 to 10 and 11A–11N, a second embodiment of the present invention will be described in detail.

Figure 8:
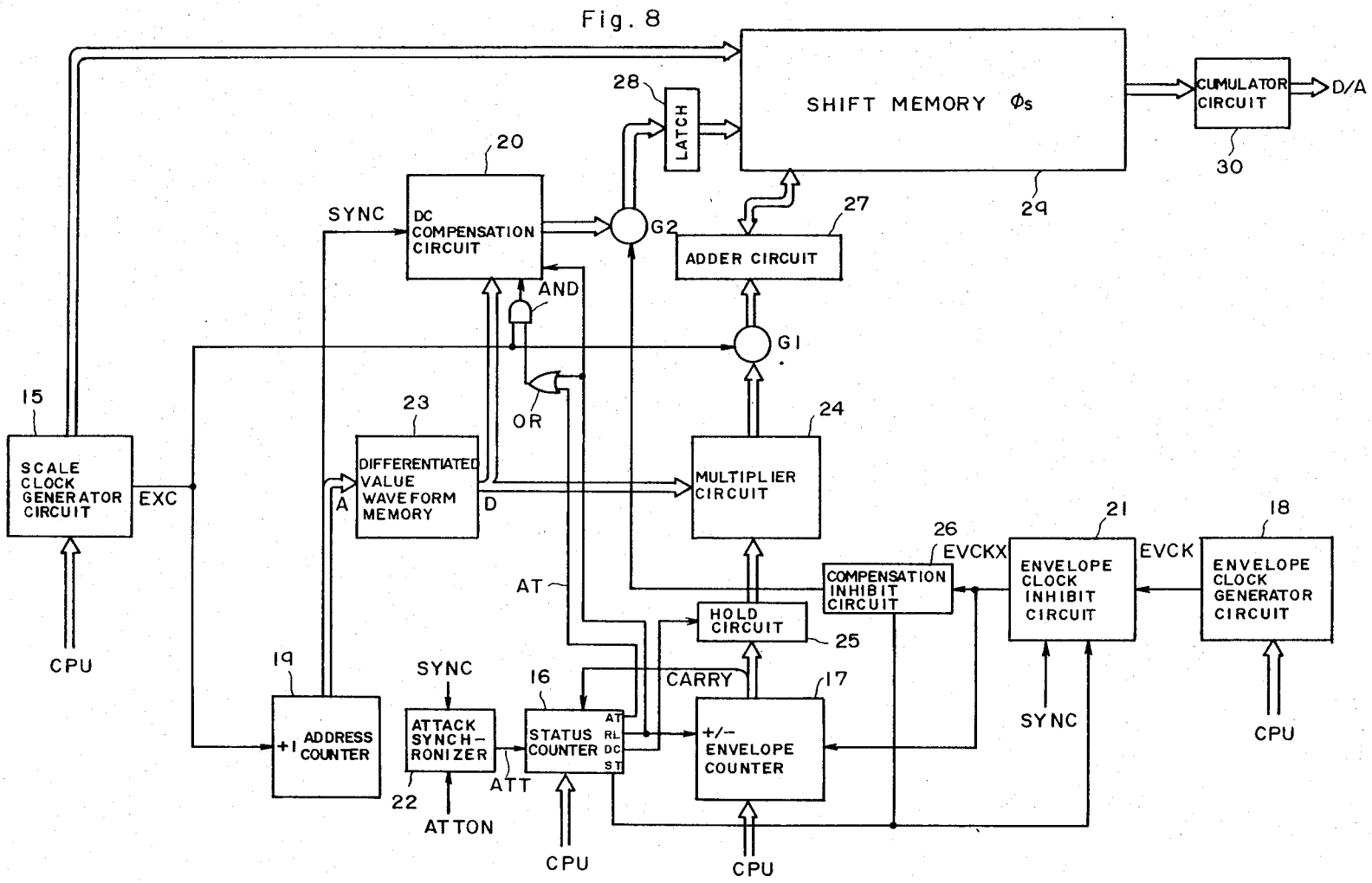
FIG. 8 is a circuit arrangement diagram of a second embodiment of the present invention.

FIG. 8 is a circuit arrangement diagram of the second embodiment of the present invention. The same circuits as in the case of the first embodiment are assigned the same symbols, and will not be repeatedly explained. In addition, signals are denoted by the same symbols as in the prior-art example and the first embodiment.

A musical scale clock generator circuit 15, a status counter 16, an envelope counter 17 and an envelope clock generator circuit 18 are connected to a processor CPU. The signal EXC of the scale clock generator circuit 15 is applied to the input terminal of a gate circuit G1, the first input terminal of an AND circuit AND and the +1 input terminal of an address counter 19. The SYNC output of the address counter 19 is applied to the SYNC input terminals of a DC (direct current) compensation circuit 20, an envelope clock inhibit circuit 21 and an attack synchronizer 22. The lines of connection for the signal SYNC entering the attack synchronizer 22 and the envelope clock inhibit circuit 21 are omitted from the drawing. The address output terminals of the address counter 19 are connected to the address terminals A of a differentiated value waveform memory 23. The output D of the waveform memory 23 is applied to a multiplier circuit 24 and the DC compensation circuit 20. The attack synchronizer 22 is further supplied with an attack-on signal ATTON, and its output is applied to the status counter 16. The AT output terminal of the status counter 16 is connected to the first input terminal of an OR circuit OR. The RL (release) output terminal of the status counter 16 is connected to the second input terminal of the OR circuit OR and also to the DC compensation circuit 20 and envelope counter 17. The output of the OR circuit OR is applied to the second input terminal of the AND circuit AND, the output of which is applied to the DC compensation circuit 20. The DC output terminal of the status counter 16 is connected to the hold terminal of a hold circuit 25, and the stop signal ST terminal thereof to the envelope clock inhibit circuit 21 and a compensation inhibit circuit 26. The output of the envelope counter 17 is applied to the second addition input terminals of the adder circuit 27 through the hold circuit 25, multiplier circuit 24 and gate circuit G1. In addition, the carry output of the envelope counter 17 is applied to the status counter 16. The envelope clock of the envelope clock generator circuit 18 is applied to the envelope clock inhibit circuit 21, the output of which is applied to the envelope counter 17 and compensation inhibit circuit 26. The envelope clock output of the compensation inhibit circuit 26 enters the gate input of the gate circuit G2. The output of the DC compensation circuit 20 is applied to a latch 28 through the gate circuit G2. The output of the latch 28 is coupled to a shift memory 29. The adder circuit 27 is connected with the shift memory 29, the shift output of which enters a cumulator circuit 30. The shift memory 29 is also supplied with an address signal from the scale clock generator circuit 15. The output of the cumulator circuit 15 is coupled to a digital-to-analog converter D/A not shown in FIG. 8.

The operations of the embodiment of the present invention in FIG. 8 will now be described with reference to the timing chart shown in FIG. 11A–11N.

In the present embodiment, the frequency of the system clock signal $\phi_s$ is divided in eight in order to simultaneously generate eight musical sounds. Every eighth clock of the system clock signal $\phi_3$ is used as one channel, and eight channels are thus prepared. For example, in a case where three play keys have been simultaneously depressed, the timing clock pulses EXC corresponding to the respective musical scales are delivered from the scale clock generator circuit 15. At that time, three channels are allotted to the respective pulses EXC, which are provided from the scale clock generator circuit 15 while shifting in phase from one another within the cycle of the system clock $\phi_s$. All the subsequent processing steps are controlled by the processor CPU so as to proceed for the individual channels. In the description of the present embodiment, however, only one channel shall be mentioned in order to avoid complication. Accordingly, the timing chart of FIGS. 11A–11N depicts only one channel in the present embodiment. Since the description of the operations overlap that concerning the first embodiment in many points, the same points shall be omitted.

An envelope value and a differentiated value are multiplied in the multiplier circuit 24, the output of which is applied to the adder circuit 27 via the gate circuit G1. As in the case of the first embodiment, the DC compensation circuit 20 receives differentiation data from the differentiated value waveform memory 23, calculates a compensative value and delivers the result to the latch 28 via the gate G2. The compensative value output of the latch 28 is stored in the shift memory 29, and the data stored in the shift memory 29 is inputted into the adder circuit 27 and added with the waveform value by the adder circuit 27, the resultant sum being stored in the shift memory 29 again.

Since, however, the shift memory 29 is shifting the contents sequentially at the timings of the system clock $\phi_s$, an address control is required for writing and reading the data into and from the shift memory 29 as described above. The address control is effected by the use of the output of the scale clock generator circuit 15, which is described in detail in UK Patent Application GB 2017376A.

The embodiment of the present invention shown in FIG. 8 has the function of generating a plurality of sounds at the same time. The scale clock generator circuit 15, status counter 16, envelope counter 17, envelope clock generator circuit 18, address counter 19, DC compensation circuit 20, envelope clock inhibit circuit 21 and attack synchronizer 22 are respectively furnished with shift registers for producing the plurality of sounds. These shift registers shift data in accordance with the system clock $\phi_s$. That is, the shift registers constitute a closed loop so as to effect the various functions, and the data are shifted along the loop by the system clock $\phi_s$, whereby the operations for generating the corresponding musical sounds as above described are carried out.

The foregoing operations corresponding to the plurality of musical sounds are successively executed, and the data are stored in the shift memory 29. The data concerning the direct current compensation are applied to the shift input of the shift memory 29 through the latch 28, and are sequentially shifted toward the output side thereof. The variation value of each musical sound enters the adder circuit 27 through the gate circuit G1. The augend value at this time is the content of the address of the shift memory 29 appointed by the scale clock generator circuit 15, and the result is written into the same address of the shift memory 29.

The shift output of the shift memory 29 enters the accumulated circuit 30 so as to be cumulated, and the cumulative value is subjected to digital-to-analog conversion, whereby a musical sound waveform is formed.

The attack synchronizer 22 is identical in circuit arrangement with the attack synchronizer 8 of the first embodiment shown in FIG. 5, except that the register R1 is replaced with a shift register R1' because the present embodiment processes the plurality of musical sounds. Referring to FIG. 5, a loop is formed of the shift register R1', AND gate AN1 and OR gate 01. When the shift register R1' has 8 steps as described before, the loop stores the attack-on signals ATTON corresponding to musical sounds for 8 channels. Each time the synchronizing signal SYNC corresponding to one channel is inputted, the shift register R1' is reset, and the corresponding attack signal ATT is provided. The data of the shift register R1' is shifted and outputted by the system clock $\phi_s$.

Figure 9:
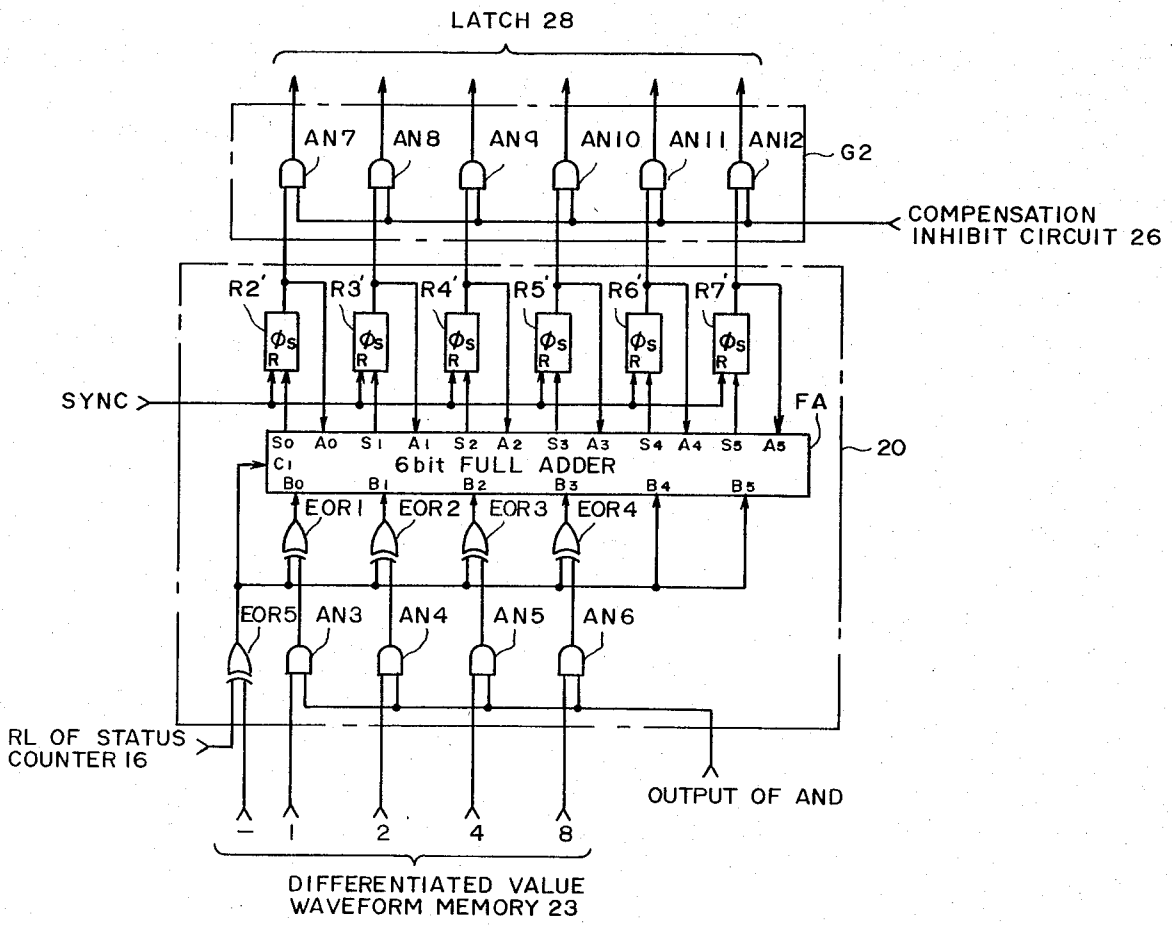
FIG. 9 is a circuit arrangement diagram of a DC compensation circuit as well as a gate circuit in the embodiment of FIG. 8.

FIG. 9 is a circuit diagram of the DC compensation circuit 20 as well as the gate circuit G2. The circuit arrangement is substantially the same as in the first embodiment. In the present embodiment, however, the registers R2–R7 in the first embodiment become shift registers R2'–R7', and the output of the gate circuit G2 is connected to the latch 28.

When the AND circuits AN3–AN6 are turned "on" by the timing clock EXC inputted through the AND circuit AND, the signals inputted from the differentiated value waveform memory 23 are respectively passed through the exclusive-or circuits EOR1–EOR4 and then added with values, stored in the output bits of the shift registers R2'–R7', by the full adder FA. The results are respectively delivered as the sum signals $S_0$–$S_5$ and stored in the shift registers R2'–R7' again. The output of the exclusive-or circuit EOR5 is a signal which specifies addition or subtraction. When it is at its "H" level, a subtracting operation is conducted, and when it is at its "L" level, an adding operation is conducted. The full adder FA is an adder, but two's complements are formed under some conditions owing to the exclusive-or circuits EOR1–EOR4 which are respectively connected to the addend inputs $B_0$–$B_3$. In this case, the subtraction is conducted. Since the compensative values are opposite in sign between the statuses of the attack AT and the release RL, the exclusive-or circuit EOR5 determines the processing in accordance with the exclusive OR between the release RL of the status counter 16 and the data of the differentiated value waveform memory 23. More specifically, when the status is the release RL, the output of the exclusive-or circuit EOR5 becomes the addition signal for the minus data of the differentiated value waveform memory 23, and it becomes the subtraction signal for the plus data. When the status is not the release RL, the output of the circuit EOR5 becomes the subtraction signal for the minus data of the differentiated value waveform memory 23, and it becomes the addition signal for the plus data. The shift registers R2′-R7′ in which the added results of the full adder FA are stored have the musical sound waveform values of a plurality of musical sounds at the time at which the envelope value is 1, and the sign of the waveform values is the opposite at the release RL as stated before. The synchronizing signal SYNC applied to the reset terminals of the shift registers R2′-R7′ serves to reset the input bits of these registers every cycle of the musical sound. That is, the data to be stored in the shift registers R2′-R7′ have the opposite plus and minus directions in accordance with the statuses, and they are synchronized by the synchronizing signal SYNC. That is, in order to perfectly synchronize the data to the synchronizing signal SYNC, the corresponding bits or the input bits of the shift registers R2′-R7′ are cleared. When the shift registers R2′-R7′ are shift registers of eight steps, they store musical sound waveforms corresponding to musical sounds for eight channels. The waveform data of the respective channels are delivered from the shift registers R2′-R7′ in synchronism with the shift register R1′ of the attack synchronizer 22. They are applied to the gate circuit G2, and also have the differentiated values added by the full adder FA, to obtain the next waveform. In accordance with the next system clock $\phi_s$, the output of the full adder FA is fed into the shift registers R2′-R7′, and calculations corresponding to the next channel are executed. In this way, the calculation processing steps of the eight channels or the calculations of the DC compensative values are executed.

Figure 10:
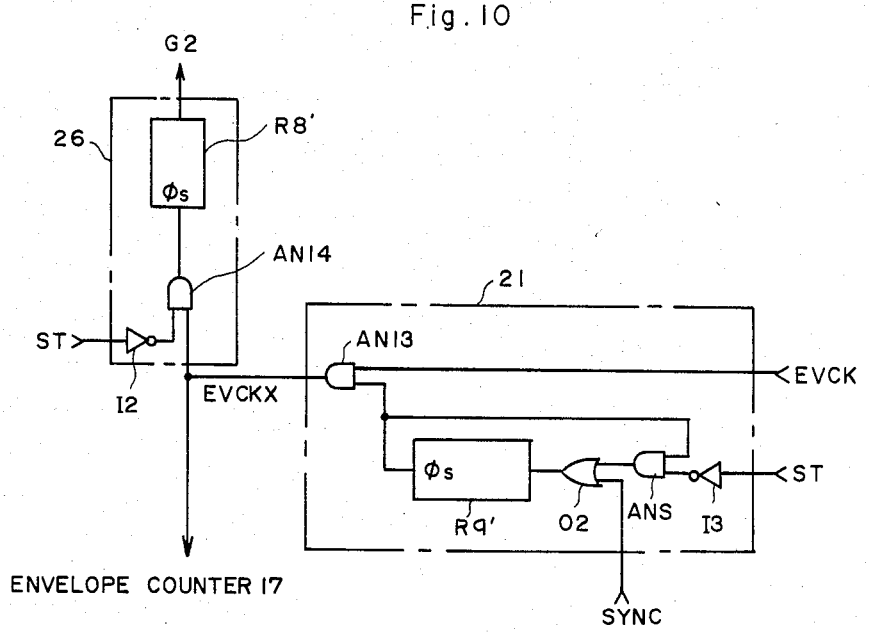
FIG. 10 is a circuit arrangement diagram of an envelope clock inhibit circuit as well as a compensation inhibit circuit in FIG. 8.

FIG. 10 shows a circuit diagram of the envelope clock inhibit circuit 21 as well as the compensation inhibit circuit 26. The envelope clock EVCK of the envelope clock generator circuit 18 enters the first input of an AND circuit AN13. The synchronizing signal SYNC enters a shift register R9′ through an OR circuit 02, while the stop signal ST enters the shift register R9′ through an inverter I3, an AND circuit ANS and the OR circuit 02. The output of the shift register R9′ is applied to an AND circuit AN13 and also to the AND circuit ANS. The output of the AND circuit AN13, namely, the signal EVCKX enters the envelope counter 17 and an AND circuit AN14 constituting the compensation inhibit circuit 26. The AND circuit AN14 is also supplied with the stop signal ST through an inverter I2, and its output enters the gate circuit G2 through a shift register R8′. When the stop signal ST is inputted, the input bit of the shift register R9′ becomes its "L" level through the inverter I3, AND circuit ANS and OR circuit 02. This level is sequentially shifted to be delivered to the AND circuit AN13. When the output of the shift register R9′ is at the "L" level, the envelope clock EVCK having entered the AND circuit AN13 fails to be delivered. When the synchronizing signal SYNC is inputted next the stop signal ST, the input bit of the shift register R9′ becomes its "H" level, which is shifted leftwards to reach the output bit of the shift register R9′. Then, the AND circuit AN13 is turned "on" to deliver the envelope clock EVCK. The delivered signal is the signal EVCKX, which is applied to the envelope counter 17 and also to the AND circuit AN14. That is, the bit of the shift register R9′ corresponding to one of the plurality of musical sounds stores a flag for inhibiting the delivery of the envelope clock EVCK owing to the stop signal ST during the period from the reception of the stop signal ST to the reception of the synchronizing signal SYNC. Even when, the stop signal ST has been received, the envelope clock EVCK at that time continues to be delivered through the AND circuit AN13 until the corresponding bit data is provided from the shift register R9′. In other words, although the shift register R9′ is a register for storing the stop signals ST corresponding to the respective channels, the output thereof is its "H" level when the stop signal ST has been applied for the corresponding channel. Therefore, the envelope clock EVCK is outputted through the AND circuit AN13. It is the compensation inhibit circuit 26 that inhibits the envelope clock EVCK at this time. The AND circuit AN14 is turned "off" by the inverted signal of the stop signal ST, and the shift register R8′ is not supplied with the signal EVCKX at this time.

FIG. 11M shows a compensation enable signal which is applied to the gate circuit G2. Clock pulses marked x in this figure are inhibited by the compensation inhibit circuit 26.

What is claimed is:

1. An electronic musical instrument, comprising:

a musical note clock generation means for generating a musical note clock which corresponds to a musical note designated by an operated key;

storage means for storing differential data of musical sound waveforms;

envelope clock generation means for generating an envelope clock which is in asynchronous relation with said musical note clock;

envelope generation means for generating envelope data in synchronism with said envelope clock;

multiplication means for multiplying the differential data when read out from said storage means according to the timing of the note clock outputted from said musical note clock generation means, by envelope data outputted from said envelope generation means, and for producing a corresponding output;

direct current compensation means for receiving the outputs of said multiplication means and said storage means, and for canceling a direct current component of the output of said multiplication means, said direct current component being one which would otherwise be produced due to the asynchronous relation between said musical note clock and said envelope clock; and means for accumulating the output of said direct current compensation means and for generating a musical sound waveform on the basis of the output of said multiplication means, the direct current component of the output of said multiplication means being canceled by said direct current compensation means.

2. An electronic musical instrument according to claim 1, wherein said direct current compensation means comprises:

accumulates means which cumulates the differential data of the musical sound waveforms stored in said storage means; and an adder circuit which adds an output of said cumulator means and the output of said multiplication means.

3. An electronic musical instrument according to claim 1, wherein said envelope generation means includes envelope status storage means for storing envelope status data comprising attack, decay and release data.

4. An electronic musical instrument according to claim 1, wherein said envelope generation means includes envelope status storage means for storing envelope status data comprising attack, decay and release data, and said direct current compensation means comprises a compensation inhibit circuit for receiving the output of said envelope status storage means and inhibiting compensation operation at a point in time corresponding to a change in envelope status.

5. An electronic musical instrument, comprising:

musical note clock generation means for generating a musical note clock which corresponds to respective musical notes designated by a plurality of play keys operated simultaneously;

first storage means for storing differential data of musical sound waveforms;

envelope clock generation means for generating an envelope clock which is asynchronous relation with said musical note clock;

envelope generation means for generating envelope data in synchronism with said envelope clock;

multiplication means for multiplying the differential data when read out from said first storage means according to the timings of the respective note clocks outputted from said musical note clock generation means, by envelope data outputted from said envelope generation means, and for producing a corresponding output;

direct current compensation means for receiving the outputs of said multiplication means and said storage means, and for canceling a direct current component of the output of said multiplication means, said direct current component being one which would otherwise be produced due to the asynchronous relation between said musical note clock and said envelope clock; and means for accumulating the output of said direct current compensation means and for generating a musical sound waveform on the basis of the output of said multiplication means, the direct current component of the output of said multiplication means being canceled by said direct current compensation means.

6. An electronic musical instrument according to claim 5, wherein said envelope generation means includes envelope status storage means for storing envelope status data comprising attack, decay and release data.

7. An electronic musical instrument according to claim 5, wherein said envelope generation means includes envelope status storage means for storing envelope status data comprising attack, decay and release data, and said direct current compensation means comprises a compensation inhibit circuit for receiving the output of said envelope status storage means and inhibiting compensation operation at a point in time corresponding to a change in envelope status.

8. An electronic musical instrument according to claim 5, wherein said direct current compensation means comprises:

a cumulator circuit which cumulates the differential data of the fundamental waveforms stored in said first storage means;

second storage means for storing cumulative values outputted from said cumulator circuit; and addition means for adding the cumulative values read out from said second storage means and the outputs of said multiplication means.

9. An electronic musical instrument according to claim 8, wherein outputs of said addition means are stored in said second storage means again.

10. An electronic musical instrument according to claim 9, wherein said second storage means is a shift memory.

* * * * *